US009932776B2

(12) United States Patent
Logan et al.

(10) Patent No.: US 9,932,776 B2
(45) Date of Patent: Apr. 3, 2018

(54) PINNED ELECTROMAGNETIC TELEMETRY GAP SUB ASSEMBLY

(71) Applicant: EVOLUTION ENGINEERING INC., Calgary (CA)

(72) Inventors: Aaron W. Logan, Calgary (CA); Justin C. Logan, Calgary (CA); Patrick R. Derkacz, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 224 days.

(21) Appl. No.: 14/770,353

(22) PCT Filed: Feb. 28, 2014

(86) PCT No.: PCT/CA2014/050155

§ 371 (c)(1),
(2) Date: Aug. 25, 2015

(87) PCT Pub. No.: WO2014/131133

PCT Pub. Date: Sep. 4, 2014

(65) Prior Publication Data

US 2016/0032660 A1 Feb. 4, 2016

Related U.S. Application Data

(60) Provisional application No. 61/771,701, filed on Mar. 1, 2013.

(51) Int. Cl.
*E21B 17/02* (2006.01)
*E21B 17/042* (2006.01)
(Continued)

(52) U.S. Cl.
CPC ..... *E21B 17/003* (2013.01); *E21B 17/042* (2013.01); *E21B 47/122* (2013.01); *H01R 4/70* (2013.01); *H01R 13/20* (2013.01)

(58) Field of Classification Search
CPC ..... E21B 17/02; E21B 17/042; E21B 17/043; E21B 17/046; E21B 17/003; H01R 4/70; H01R 13/20
(Continued)

(56) References Cited

U.S. PATENT DOCUMENTS 3,323,327 A 5/1965 Leathers et al.
3,301,581 A * 1/1967 Winberg ..... E21B 17/046 285/404
(Continued)

FOREIGN PATENT DOCUMENTS

GB 2404401 A 2/2005
WO 2004051050 A1 6/2004
(Continued)

*Primary Examiner* — Cathleen R Hutchins
(74) *Attorney, Agent, or Firm* — Oyen Wiggs Green & Mutala LLP

(57) ABSTRACT

A gap sub comprises a female member comprising a first and second plurality of apertures, and a male member comprising a first and second plurality of cavities. A plurality of non-conductive pins may be inserted through the second plurality of apertures and the second plurality of cavities, thereby locking the relative positions of the female and male members. A plurality of conductive pins may be inserted through the first plurality of apertures and the first plurality of cavities such that there are no electrical connections between the conductive pins and the male member. A dielectric material may be inserted between the male member and the conductive pins.

30 Claims, 5 Drawing Sheets

(51) Int. Cl.

| | |
|---|---|
| ***E21B 17/043*** | (2006.01) |
| ***E21B 17/046*** | (2006.01) |
| ***H01R 4/70*** | (2006.01) |
| ***H01R 13/20*** | (2006.01) |
| ***E21B 17/00*** | (2006.01) |
| ***E21B 47/12*** | (2012.01) |

(58) Field of Classification Search
USPC ..... 285/90–91, 404, 333–334, 390
See application file for complete search history.

(56) References Cited

U.S. PATENT DOCUMENTS

| | | | | |
|---|---|---|---|---|
| 4,176,894 | A | | 12/1979 | Godbey |
| 4,348,672 | A | | 9/1982 | Givler |
| 4,496,174 | A | | 1/1985 | McDonald et al. |
| 4,684,946 | A | | 8/1987 | Issenmann |
| 4,739,325 | A | | 4/1988 | MacCleod |
| 4,907,828 | A | * | 3/1990 | Chang ..... E21B 47/011 285/184 |
| 5,130,706 | A | | 7/1992 | Van Steenwyk |
| 5,138,313 | A | | 8/1992 | Barrington |
| 5,236,048 | A | | 8/1993 | Skinner et al. |
| 5,406,983 | A | | 4/1995 | Chambers et al. |
| 5,467,832 | A | | 11/1995 | Orban et al. |
| 5,749,605 | A | | 5/1998 | Hampton, III et al. |
| 5,883,516 | A | | 3/1999 | Van Steenwyk et al. |
| 6,050,353 | A | | 4/2000 | Logan et al. |
| 6,098,727 | A | | 8/2000 | Ringgenberg et al. |
| 6,158,532 | A | | 12/2000 | Logan et al. |
| 6,404,350 | B1 | | 6/2002 | Soulier |
| 6,515,592 | B1 | | 2/2003 | Babour et al. |
| 6,727,827 | B1 | | 4/2004 | Edwards et al. |
| 6,750,783 | B2 | | 6/2004 | Rodney |
| 6,926,098 | B2 | | 8/2005 | Peter |
| 7,151,466 | B2 | | 12/2006 | Gabelmann et al. |
| 7,243,028 | B2 | | 7/2007 | Young et al. |
| 7,252,160 | B2 | | 8/2007 | Dopf et al. |
| 7,255,183 | B2 | | 8/2007 | Cramer |
| 7,326,015 | B2 | | 2/2008 | Reynolds, Jr. |
| 7,387,167 | B2 | | 6/2008 | Fraser et al. |
| 7,573,397 | B2 | | 8/2009 | Petrovic et al. |
| 7,605,716 | B2 | | 10/2009 | Peter et al. |
| 7,839,719 | B2 | | 11/2010 | Dopf et al. |
| 7,900,968 | B2 | | 3/2011 | Camwell et al. |
| 8,154,420 | B2 | | 4/2012 | Petrovic et al. |
| 2004/0104047 | A1 | | 6/2004 | Peter |
| 2006/0201717 | A1 | | 9/2006 | Cramer |
| 2006/0202852 | A1 | | 9/2006 | Peter et al. |
| 2007/0247328 | A1 | | 10/2007 | Petrovic et al. |
| 2009/0065254 | A1 | | 3/2009 | Peter |
| 2009/0066334 | A1 | | 3/2009 | Peter |
| 2010/0033344 | A1 | | 2/2010 | Rozenblit et al. |
| 2011/0254695 | A1 | | 10/2011 | Camwell et al. |
| 2011/0309949 | A1 | | 12/2011 | Dopf et al. |
| 2012/0085583 | A1 | | 4/2012 | Logan et al. |
| 2014/0131994 | A1 | | 5/2014 | Holmen et al. |

FOREIGN PATENT DOCUMENTS

| | | | |
|---|---|---|---|
| WO | 2006083764 | A1 | 8/2006 |
| WO | 2009086637 | A1 | 7/2009 |
| WO | 2010121345 | A1 | 10/2010 |
| WO | 2010121346 | A1 | 10/2010 |
| WO | 2011049573 | A1 | 4/2011 |
| WO | 2011133399 | A1 | 10/2011 |
| WO | 2012042499 | A2 | 4/2012 |
| WO | 2013185005 | A2 | 12/2013 |
| WO | 2014075190 | A1 | 5/2014 |

* cited by examiner

PINNED ELECTROMAGNETIC TELEMETRY GAP SUB ASSEMBLY

REFERENCE TO RELATED APPLICATIONS

This application claims priority from U.S. Application No. 61/771,701 filed 1 Mar. 2013. For purposes of the United States, this application claims the benefit under 35 U.S.C. § 119 of U.S. Application No. 61/771,701 filed 1 Mar. 2013 and entitled ELECTROMAGNETIC TELEMETRY GAP SUB ASSEMBLY WITH INSULATING COLLAR which is hereby incorporated herein by reference for all purposes.

TECHNICAL FIELD

This application relates to gap sub assemblies. Embodiments provide gap sub-assemblies suitable for use in electromagnetic telemetry for downhole tools and methods for fabricating gap sub-assemblies.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals typically are more strongly attenuated than low frequency signals.) The electromagnetic signals may be detected at the surface, for example by measuring electrical potential differences between the drill string and one or more ground rods.

The gap sub is subject to high mechanical loads, and it must be strong enough to withstand these loads. Gap subs typically comprise insulating materials, and insulating materials are typically weaker than conducting materials. Thus it can be challenging to design a gap sub that meets the dual requirements of electrical insulation and mechanical strength.

There remains a need for improved methods and apparatus providing gap subs in drill strings.

SUMMARY

This invention has a number of aspects. One aspect provides constructions for gap subs. Another aspect provides methods for making gap subs.

One aspect provides a gap sub comprising a female member, a male member, and plurality of conductive pins. The female member comprises a first plurality of apertures corresponding to the plurality of conductive pins and the male member comprises a first plurality of cavities corresponding to the plurality of conductive pins. The conductive pins are insertable into the first plurality of apertures and the first plurality of cavities such that no electrical connections are made between the female and male members via the conductive pins.

In some embodiments of the invention, the conductive pins are insertable into the first plurality of apertures and the first plurality of cavities such that that the conductive pins are electrically insulated from the male member.

In some embodiments of the invention, the first plurality of cavities are larger than the conductive pins, and the conductive pins are insertable into the first plurality of cavities to define a plurality of spaces between the conductive pins and the male member.

In some embodiments of the invention, the conductive pins are insertable into the first plurality of apertures via a threaded connection, a press fit, or a tapered jam fit.

In some embodiments of the invention, the conductive pins do not make electrical connections with the female member, rather than the male member.

Some embodiments of the invention comprise a dielectric material which is insertable into the plurality of spaces.

In some embodiments of the invention, the female member comprises a second plurality of apertures corresponding to the plurality of non-conductive pins, the male member comprises a second plurality of cavities corresponding to the plurality of non-conductive pins; and the non-conductive pins are insertable into the second plurality of apertures and the second plurality of cavities such that the female member is locked into a fixed position relative to the male member.

In some embodiments of the invention, the fixed position is a position in which the first plurality of apertures is aligned with the first plurality of cavities.

In some embodiments of the invention, the conductive pins comprise metal pins.

Another aspect of the invention provides a method for making a gap sub. The method comprises providing a female member comprising a first and second plurality of apertures; providing a male member comprising a first and second plurality of cavities; positioning the female member relative to the male member so that the first plurality of apertures aligns with the first plurality of cavities; inserting a plurality of non-conductive pins into the second plurality of apertures and the second plurality of cavities, thereby locking the female member into a fixed position relative to the male member; and inserting a plurality of conductive pins into the first plurality of apertures and the first plurality of cavities such that no electrical connection is formed between the female and male members via the conductive pins.

In some embodiments of the invention, the method comprises inserting the conductive pins into the first plurality of apertures and the first plurality of cavities such that no electrical connection is formed between the conductive pins and the male member.

In some embodiments of the invention, the method comprises inserting a dielectric material between the conductive pins and the male member.

In some embodiments of the invention, the method comprises inserting the conductive pins into the first plurality of apertures and the first plurality of cavities such that no electrical connection is formed between the conductive pins and the female member.

In some embodiments of the invention, the method comprises inserting a dielectric material between the conductive pins and the female member.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
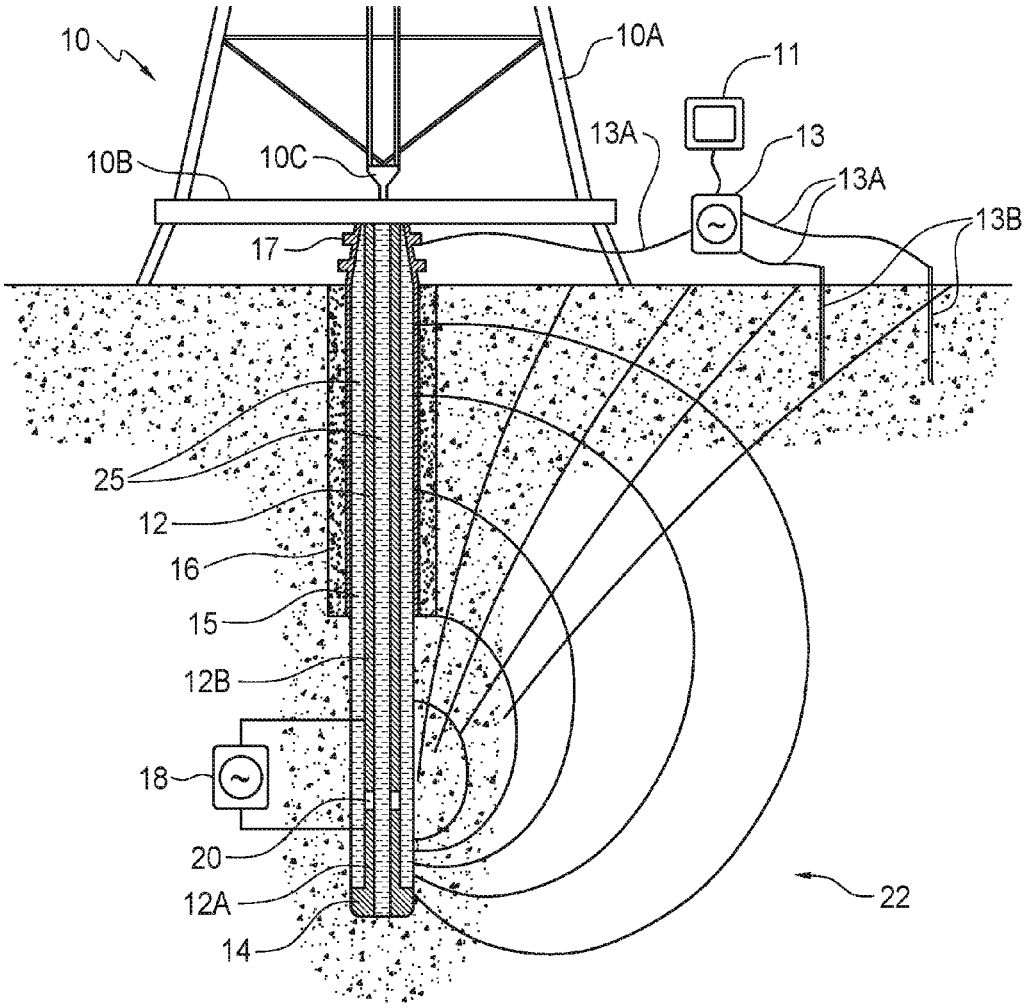
FIG. 1 (PRIOR ART)
FIG. 1 is a schematic view of a drilling operation and telemetry system.

FIG. 1 shows schematically an example drilling operation with an electromagnetic telemetry system. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid 25. Drilling fluid 25 is pumped through a bore in drill string 12 to drill bit 14 and returns to the surface through annular region 15 carrying cuttings from the drilling operation. As the well is drilled, a casing 16 may be made in the well bore. A blow out preventer 17 is supported at a top end of the casing.

Drill string 12 includes a downhole gap sub 20. Downhole gap sub 20 electrically insulates a lower portion 12A of drill string 12, which is below downhole gap sub 20, from an upper portion 12B of drill string 12, which is above downhole gap sub 20. Lower portion 12A is connected to drill bit 14, and drill bit 14 is in contact with ground 22.

A signal generator 18 is electrically connected across downhole gap sub 20 to both lower portion 12A and upper portion 12B. (In FIG. 1, signal generator 18 is shown outside of drill string 12 for ease of illustration, but it is to be understood that signal generator 18 is typically located within a bore of drill string 12, often as part of a probe.)

Signal generator 18 generates a variable potential difference between lower portion 12A and upper portion 12B. Data (obtained by a probe or by other means) is encoded into a signal comprising a particular pattern of variation of potential difference.

The EM signal produced by signal generator 18 is received by a signal receiver 13. Signal receiver 13 is connected to measure the signal generated by signal generator 18. In some embodiments, signal receiver 13 is connected by signal cables 13A to electrical grounding stakes 13B and to blow out preventer 17. In other embodiments, signal receiver 13 is connected in other ways.

Figure 2:
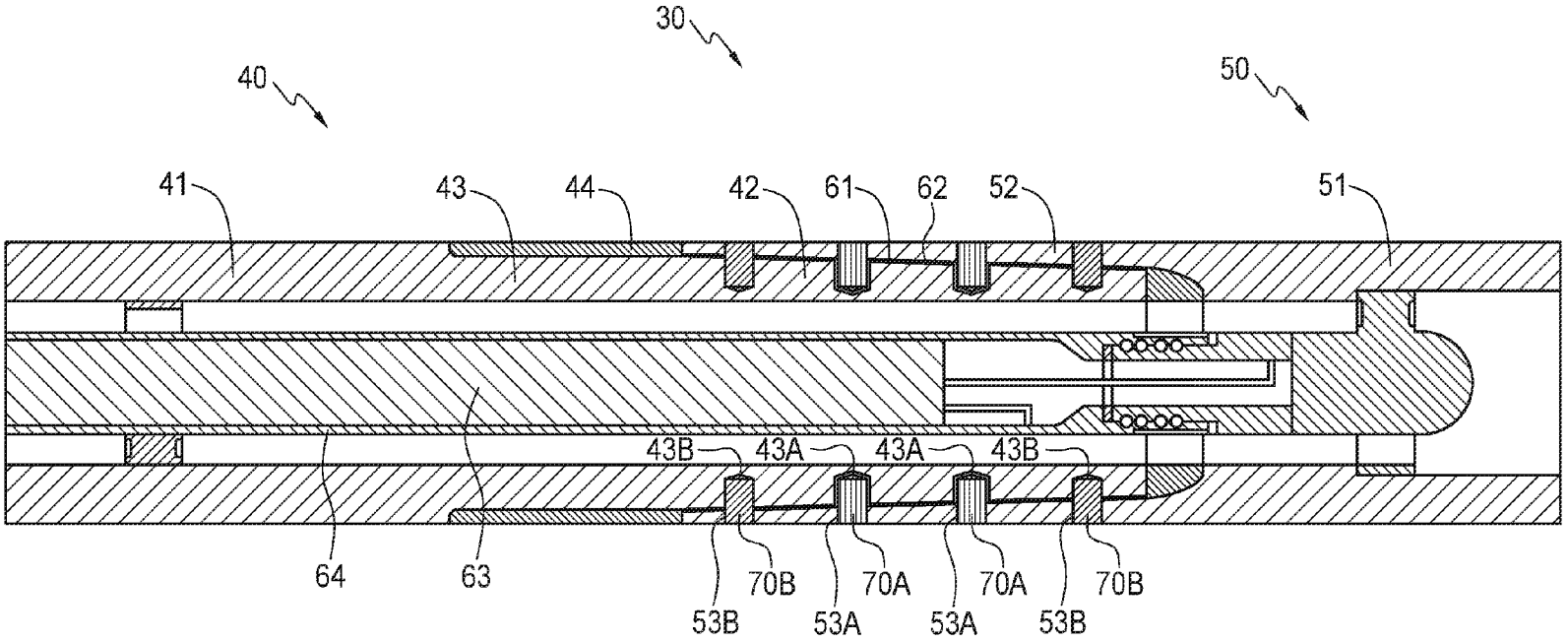
FIG. 2 is a cross sectional view of a gap sub assembly according to an example embodiment.
Figure 2A:
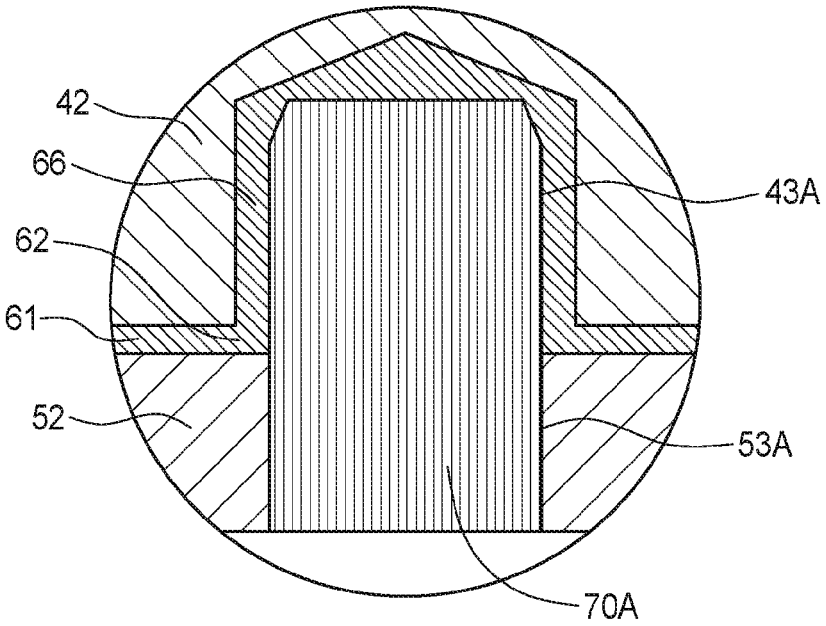
FIGS. 2A and 2C are cross section views of a conductive pin of FIG. 2.
Figure 2B:
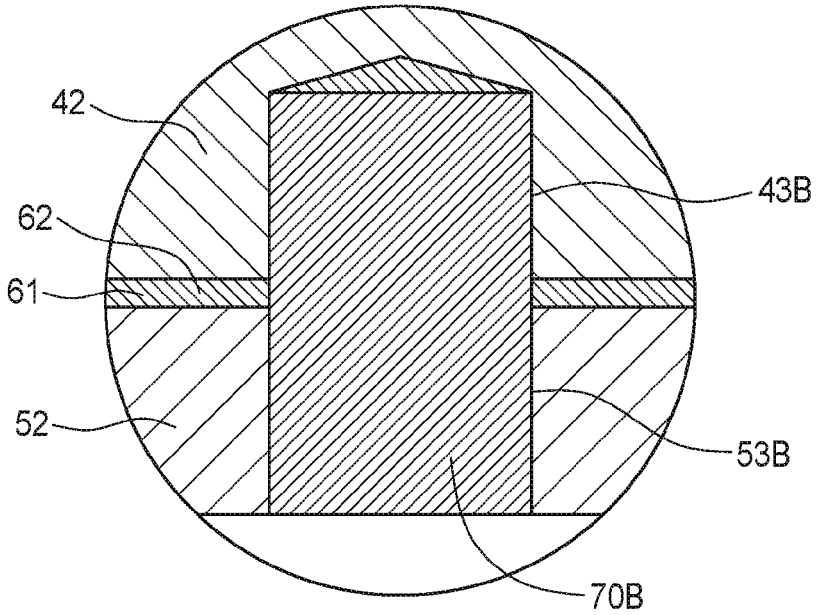
FIGS. 2B and 2D are cross section views of a non-conductive pin of FIG. 2.
Figure 2C:
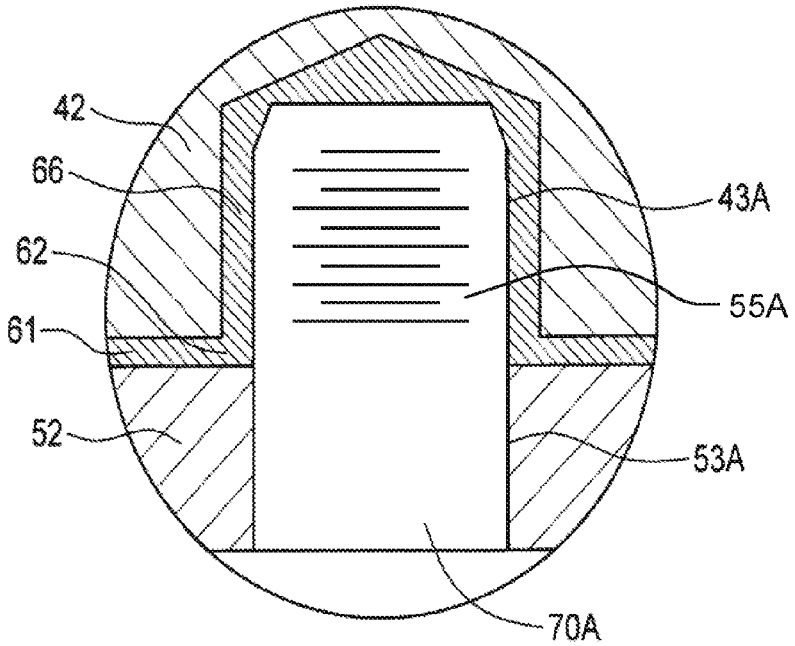
Figure 2D:
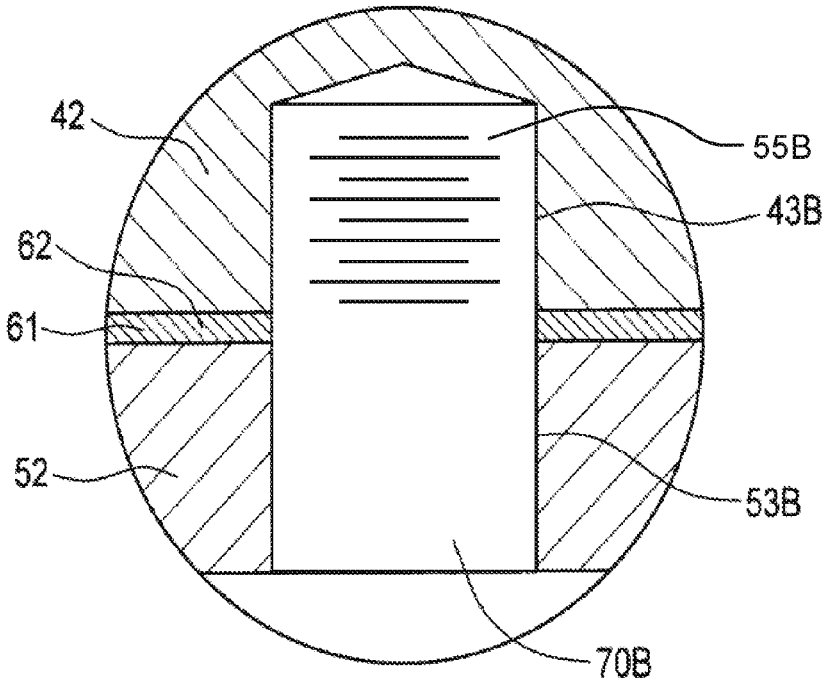

FIG. 2 shows a gap sub 30 with a pinned connection according to an example embodiment of the invention. Gap sub 30 includes a male member 40 mated with a female member 50. In the illustrated embodiment, male member 40 is downhole relative to female member 50. In other embodiments of the invention, female member 50 is downhole relative to male member 40.

Male member 40 comprises an electrically conductive body with a bore therethrough. Male member 40 has an annular cross section. Male member 40 comprises a non-mating section 41, a mating section 42, and a gap section 43.

In the illustrated embodiment, the external diameter of mating section 42 is tapered. In other embodiments, the external diameter of mating section 42 may have other shapes. In some embodiments, the external diameter of mating section 42 is uniform.

The external diameter of gap section 43 may be less than the external diameter of non-mating section 41. Gap section 43 may be surrounded by an insulating collar 44.

Female member 50 comprises an electrically conductive body with a bore therethrough. Female member 50 has an annular cross section. Female member 50 comprises a non-mating section 51 and a mating section 52. The internal diameter of mating section 52 has a taper that corresponds to the taper of male mating section 42. The internal diameter of each part of female mating section 52 is greater than the external diameter of the corresponding part of male mating section 42 so that female mating section 52 fits over male mating section 42 in the assembled gap sub 30 as shown in FIG. 2.

Male and female mating sections 42, 52 are dimensioned such that there is a radial gap 61 between the external surface of male mating section 42 and the internal surface of female mating section 52 when the male and female members 40, 50 are mated together. A non-conductive, dielectric material 62 can be inserted (e.g. injected, cast, etc.) into radial gap 61.

Dielectric material 62 may be highly dielectric. Dielectric material 62 may comprise an injectable thermoplastic, an epoxy, an engineered resin, or any other suitable dielectric material.

In some embodiments, male and female mating sections are not tapered. In some embodiments, the external surface of male mating section 42 and/or the internal surface of female mating section 52 may have grooves, threads or rings (not shown) to facilitate the mating of the male and female members 40, 50.

In the illustrated embodiment, a probe 63 is mounted within the bore of male and female members 40, 50. Probe 63 may comprise a housing 64 comprising first and second parts that are electrically insulated from one another. These parts may be respectively brought into contact with opposing sides of gap sub 30.

A plurality of conductive pins 70A attach female mating section 52 to male mating section 42. Conductive pins 70A pass through a corresponding plurality of apertures 53A in female mating section 52 and into a corresponding plurality of cavities 43A in male mating section 42.

Conductive pins 70A comprise a conductive material which is suitable to withstand the mechanical loads on gap sub 30. In some embodiments, conductive pins 70A comprise a suitable metal.

Conductive pins 70A may provide gap sub 30 with strength, longevity, reliability, and predictability across a wide range of temperatures and operating conditions. Conductive pins 70A may provide significant resistance to torsional and axial loading of gap sub 30.

Conductive pins 70A are in electrical contact with female mating section 52. In some embodiments, conductive pins 70A are mounted within apertures 53A via a press fit. In some embodiments, conductive pins 70A and apertures 53A have corresponding threading 55A and conductive pins 70A may be screwed into apertures 53A.

Conductive pins 70A are not in electrical contact with male mating section 42. Cavities 43A in male mating section 42 are dimensioned such that there are spaces 66 between conducting pins 70A and male mating section 42. Space 66 may comprise a radial gap between the sides of a conducting pin 70A and male mating section 42, and a longitudinal gap between an end of conducting pin 70A and male mating section 42.

When dielectric material 62 is inserted into radial gap 61, dielectric material 62 may also fill in spaces 66. Dielectric material 62 may thus insulate conducting pins 70A from male mating section 42.

Before dielectric material 62 is inserted, male mating section 42 and female mating section 52 may be aligned such that conducting pins 70A do not touch male mating section 42. This may be accomplished in a variety of ways. For example, male and female mating sections 42, 52 may be mounted in rotatable clamps (not shown). The rotatable clamps may be adjusted so that male and female mating sections 42, 52 are in the correct relative positions. Then the rotatable clamps may be locked in place and dielectric material 62 may be inserted into radial gap 61 and spaces 66.

In another embodiment of the invention, the proper alignment of male and female mating sections 42, 52 may be accomplished by the use of non-conductive pins 70B. Non-conductive pins 70B may comprise any suitable non-conductive material. In some embodiments, non-conductive pins 70B comprise plastic or ceramic.

Non-conductive pins 70B pass through a corresponding plurality of apertures 53B in female mating section 52 and into a corresponding plurality of cavities 43B in male mating section 42. Non-conductive pins 70B, apertures 53B, and cavities 43B may be dimensioned such that when non-conductive pins 70B are inserted, male mating section 42 cannot move relative to female mating section 52, and apertures 53A are lined up with cavities 43A.

Non-conductive material is typically weaker and/or more brittle than conductive material, and thus non-conductive pins 70B are typically unable to provide a suitably strong connection between male and female members 40, 50. Non-conductive material is also typically susceptible to temperature degradation, and typically has an unpredictable fatigue life.

In some embodiments, non-conductive pins 70B are mounted within apertures 53B and cavities 43B via a press fit. In some embodiments, non-conductive pins 70B and apertures 53B and/or cavities 43B have corresponding threading 55B, and non-conductive pins 70B may be screwed into apertures 53B and/or cavities 43B.

Conductive pins 70A and non-conductive pins 70B may have a variety of different shapes. In some embodiments, the pins are cylindrical or rectangular. In some embodiments, the pins are tapered. In some embodiments, the pins are tapered such that the ends of the pins which are closest to the bore of male member 40 are the narrowest ends. In some embodiments, the pins are tapered such that the ends of the pins which are closest to the bore of male member 40 are the widest ends.

In some embodiments, conductive pins 70A and/or non-conductive pins 70B may be inserted through apertures 53A/53B and cavities 43A/43B from the exterior of female mating section 52.

In some embodiments, cavities 43A and/or 43B extend all the way through male mating section 42 and form openings into the bore of male member 40. In these embodiments, conductive pins 70A and/or non-conductive pins 70B may be inserted through cavities 43A and/or 43B and apertures 53A and/or 53B from the inside of the bore of male member 40.

In some embodiments, conductive pins 70A and/or non-conductive pins 70B may be forced into apertures 53A/53B and cavities 43A/43B by compressed air.

Figure 3:
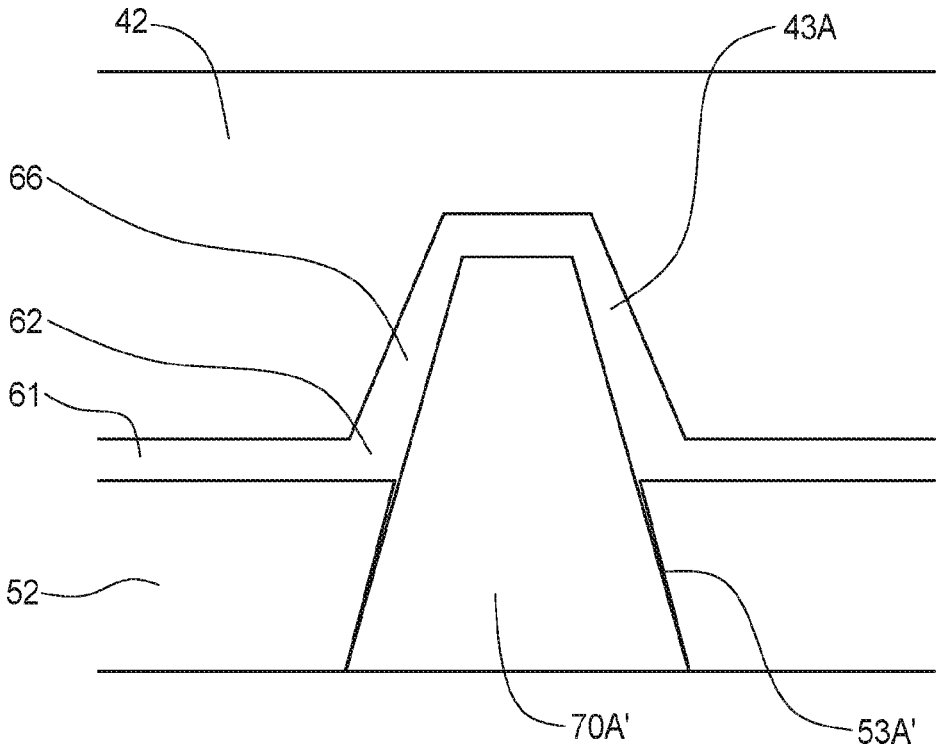
FIG. 3 is a cross section view of a conductive pin according to an example embodiment.

In some embodiments, conductive pins 70A are tapered and are forced into apertures 53A and cavities 43A by compressed air. In these embodiments, apertures 53A and conductive pins 70A may be dimensioned so that conductive pins 70A form a tapered jam fit with aperture 53A and conductive pins 70A do not touch the bottoms of cavities 43A. FIG. 3 shows a tapered conductive pin 70A' forming a jam fit with an aperture 53A'.

To assemble gap sub 30, the following steps may be carried out:

i. place insulating collar 44 over gap section 43 of male member 40;
ii. insert mating section 42 of male member 40 into mating section 52 into female member 50;
iii. align apertures 53A and 53B with cavities 43A and 43B;
iv. insert non-conductive pins 70B through corresponding apertures 53B and cavities 43B;
v. insert conductive pins 70A through corresponding apertures 53A and cavities 43A; and
vi. inject dielectric material 62 into radial gap 61, spaces 66, and any voids within insulating collar 44.

The insertion of non-conductive pins 70B in step iv acts to maintain the relative positions of male mating section 42 and female mating section 52 such that when conductive pins 70A are inserted in step v, they do not touch male mating section 42.

The number of pins and their locations may be varied depending on various factors, including the load rating of the gap sub 30. Gap sub 30 may be required to withstand approximately 100,000 to 2,000,000 pounds of axial force, and approximately 7,000 to 250,000 foot-pounds of torsional force. Pins 70A and/or 70B may be spaced apart around the circumferences of female mating section 52. In some embodiments, conductive pins 70A form two parallel, evenly spaced rows around female mating section 52. Non-conductive pins 70B form two parallel, evenly spaced rows around female mating section 52 on the outside of the rows of conductive pins 70A. In other embodiments there are other configurations of pins 70A and 70B.

Dielectric material 62 transfer loads between conducting pins 70A and male mating section 42 (or, in some embodiments, female mating section 52). When gap sub 30 is subject to axial or torsional loads, conducting pins 70A will be subject to shear forces in various directions. These shear forces will be transferred, via compressive forces, through dielectric material 62 (especially the dielectric material 62 within spaces 66) into male mating section 42 (or, in some embodiments, female mating section 52). Dielectric material 62 may be very strong in compression.

In some embodiments of the invention, conductive pins 70A are in electrical contact with male mating section 42 and are not in electrical contact with female mating section 52. In these embodiments, apertures 53A are dimensioned so that conductive pins 70A do not touch female mating section 52. The spaces between conductive pins 70A and female mating section 52 are filled with dielectric material 62.

In some embodiments of the invention, conductive pins 70A are coated with a non-conductive material. In these embodiments conductive pins 70A may physically contact both male mating section 42 and female mating section 52. In such embodiments of the invention, non-conductive pins 70B, apertures 53B, and cavities 43B may not be required. In such embodiments of the invention, there may be no spaces 66, and apertures 53A and cavities 43B may be dimensioned to form press fits with conductive pins 70A.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back"," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A gap sub comprising:

a female member;

a male member coupled to the female member, the male member at least partially inserted into a bore of the female member; and a plurality of electrically-conductive pins;

wherein:

each of the plurality of electrically-conductive pins is oriented radially relative to the gap sub and extends from a corresponding one of a first plurality of apertures in the female member into a corresponding one of a first plurality of cavities in the male member;

each of the plurality of electrically-conductive pins is electrically-insulated from at least one of the female member and the male member; and each of the plurality of electrically-conductive pins is electrically-insulated from the female member.

2. A gap sub according to claim 1 comprising a dielectric material filling a space between each of the plurality of electrically-conductive pins and the surface of a corresponding one of the first plurality of apertures.

3. A gap sub according to claim 1 wherein each of the electrically-conductive pins is coupled to a corresponding one of the first plurality of cavities by a threaded connection.

4. A gap sub according to claim 1 wherein each of the electrically-conductive pins is coupled to a corresponding one of the first plurality of cavities by a press fit.

5. A gap sub according to claim 1 wherein each of the electrically-conductive pins is tapered and each of the electrically-conductive pins is coupled to a corresponding one of the first plurality of cavities by a tapered jam fit.

6. A gap sub according to claim 1 comprising a plurality of non-electrically-conductive pins, wherein each of the plurality of non-electrically-conductive pins is inserted into a corresponding one of a second plurality of apertures in the female member and into a corresponding one of a second plurality of cavities in the male member.

7. A gap sub according to claim 6 wherein the plurality of non-electrically-conductive pins couples the female member to the male member such that each of the first plurality of apertures is aligned with a corresponding one of the first plurality of cavities.

8. A gap sub according to claim 1 wherein the pins are arranged in a plurality of rows of pins, each row extending longitudinally along the gap sub, wherein the rows are circumferentially spaced apart from one another around a circumference of the gap sub.

9. A gap sub comprising:

a first electrically-conductive member having a threaded coupling at a first end thereof and a bore at a second end thereof opposed to the first end;

a second electrically-conductive member having a threaded coupling at a first end thereof and a second end concentrically received within the bore of the first electrically-conductive member, the second end of the second electrically-conductive member spaced radially apart from an inner wall of the bore of the first electrically-conductive member by a gap filled with a dielectric material; and a plurality of pins each extending across the gap between a first aperture extending radially through the second end of the first electrically-conductive member and a second aperture in the second electrically-conductive member;

wherein each of the plurality of pins is electrically-insulated from at least one of the first and second members.

10. A gap sub comprising:

first and second electrically-conductive members mechanically coupled together and electrically insulated from one another;

a first drill string coupling on the first member at a first end of the gap sub and configured for coupling the gap sub into a drill string and a second drill string coupling at a second end of the gap sub opposed to the first end;

a bore extending through the gap sub between the first and second ends;

wherein:

an end of the first member opposed to the first coupling extends concentrically into a bore in an end of the second member opposed to the second coupling and is radially spaced apart from a wall of the bore in the second member to provide a radial gap therebetween; the radial gap containing a dielectric material; and the gap sub comprises a plurality of pins extending radially from corresponding apertures on the second member, across the gap and into corresponding cavities in the first member.

11. A gap sub according to claim 10 wherein each of the plurality of pins is electrically-conductive and is electrically-insulated from at least one of the first member and the second member.

12. A gap sub according to claim 11 wherein each one of the plurality of pins is attached to one of the first and second members.

13. A gap sub according to claim 12 wherein one or more of the plurality of pins is press-fit into the corresponding aperture.

14. A gap sub according to claim 12 wherein one or more of the plurality of pins is threadedly engaged in the corresponding aperture.

15. A gap sub according to claim 12 wherein one or more of the plurality of pins is a tapered jam fit in the corresponding aperture.

16. A gap sub according to claim 12 wherein one or more of the plurality of pins is press-fit into the corresponding cavity.

17. A gap sub according to claim 12 wherein one or more of the plurality of pins is threadedly engaged in the corresponding cavity.

18. A gap sub according to claim 12 wherein one or more of the plurality of pins is a tapered jam fit in the corresponding cavity.

19. A gap sub according to claim 10 wherein an electrically insulating material fills portions of the cavities surrounding the pins and insulates the pins from the first member.

20. A gap sub according to claim 19 wherein the electrically insulating material is the same material as the dielectric material.

21. A gap sub according to claim 10 wherein an electrically insulating material fills portions of the apertures surrounding the pins and insulates the pins from the second member.

22. A gap sub according to claim 21 wherein the electrically insulating material is the same material as the dielectric material.

23. A gap sub according to claim 10 wherein the pins are arranged in a plurality of groups spaced apart longitudinally along the gap sub, wherein the pins of each of the groups are circumferentially spaced apart around a circumference of the gap sub.

24. A gap sub according to claim 10 wherein the pins are arranged in a plurality of rows of pins, each row extending longitudinally along the gap sub, wherein the rows are circumferentially spaced apart from one another around a circumference of the gap sub.

25. A gap sub according to claim 10 comprising a plurality of non-electrically-conductive pins, wherein each of the plurality of non-electrically-conductive pins extends radially from a corresponding one of a second plurality of apertures in the second member, through the gap and into a corresponding one of a second plurality of cavities in the first member.

26. A gap sub according to claim 10 wherein the gap sub has an axial strength sufficient to withstand in the range of about 100,000 to 2,000,000 pounds (about 450 kN to 9000 kN) of axial force.

27. A gap sub according to claim 10 wherein the gap sub has a torsional strength sufficient to withstand in the range of approximately 7,000 to 250,000 foot-pounds (about 9450 Nm to about 340000 Nm) of torsional force.

28. A method for assembling a gap sub, the method comprising:

providing a female member comprising first and second pluralities of apertures;

providing a male member comprising first and second pluralities of cavities;

inserting at least a portion of the female member into a bore of the male member;

positioning the female member relative to the male member so that each of the second plurality of apertures aligns with a corresponding one of the second plurality of cavities;

inserting each of a plurality of non-electrically-conductive pins into a corresponding one of the second plurality of apertures and into a corresponding one of the second plurality of cavities, thereby locking the female member into a fixed position relative to the male member; and inserting each of a plurality of electrically-conductive pins into a corresponding one of the first plurality of apertures and into a corresponding one of the first plurality of cavities.

29. A method according to claim 28 comprising inserting a dielectric material into a space between each of the plurality of electrically-conductive pins and an inner surface of the corresponding one of the first plurality of cavities.

30. A method according to claim 28 comprising inserting a dielectric material into a space between each of the plurality of electrically-conductive pins and an inner surface of the corresponding one of the first plurality of apertures.

* * * * *